US010113747B2

(12) United States Patent
Crothers et al.

(10) Patent No.: US 10,113,747 B2
(45) Date of Patent: Oct. 30, 2018

(54) SYSTEMS AND METHODS FOR CONTROL OF COMBUSTION DYNAMICS IN COMBUSTION SYSTEM

(71) Applicant: General Electric Company, Schenectady, NY (US)

(72) Inventors: Sarah Lori Crothers, Greenville, SC (US); Hasan Karim, Simpsonville, SC (US); Joel Meador Hall, Greenville, SC (US)

(73) Assignee: General Electric Company, Schenectady, NY (US)

( * ) Notice: Subject to any disclaimer, the term of this patent is extended or adjusted under 35 U.S.C. 154(b) by 245 days.

(21) Appl. No.: 14/687,866

(22) Filed: Apr. 15, 2015

(65) Prior Publication Data

US 2016/0305337 A1 Oct. 20, 2016

(51) Int. Cl.

| | |
|---|---|
| ***F23R 3/34*** | (2006.01) |
| ***F23N 5/24*** | (2006.01) |
| ***F23R 3/44*** | (2006.01) |

(52) U.S. Cl.

CPC ..... *F23R 3/34* (2013.01); *F23N 5/247* (2013.01); *F23R 3/44* (2013.01); *F05D 2240/35* (2013.01);

(Continued)

(58) Field of Classification Search

CPC ..... F23R 3/34; F23R 3/44; F23R 290/00014; F23R 3/346; F23R 290/00014;

(Continued)

(56) References Cited

U.S. PATENT DOCUMENTS

| | | | |
|---|---|---|---|
| 2,072,826 | A | 3/1937 | Riley |
| 4,044,553 | A | 8/1977 | Vaught |

(Continued)

FOREIGN PATENT DOCUMENTS

| | | |
|---|---|---|
| EP | 1605205 | 12/2005 |
| EP | 1632718 | 3/2006 |

(Continued)

OTHER PUBLICATIONS

Burner Basics, Oct. 17, 2013, Purdue, https://engineering.purdue.edu/~propulsi/propulsion/jets/basics/burner.html.*

(Continued)

*Primary Examiner* — Craig Kim
*Assistant Examiner* — Edwin Kang
(74) *Attorney, Agent, or Firm* — Charlotte C. Wilson; Ernest G. Cusick; Frank A. Landgraff

(57) ABSTRACT

The present disclosure generally relates to a system with a gas turbine engine. The gas turbine engine includes a first combustor having a first fuel injector and a second combustor having a second fuel injector. The gas turbine engine further includes a first fuel conduit extending from a first orifice to a first fuel outlet of the first fuel injector. The first fuel conduit has a first acoustic volume between the first orifice and the first fuel outlet. The gas turbine engine further includes a second fuel conduit extending from a second orifice to a second fuel outlet of the second fuel injector. The second fuel conduit has a second acoustic volume between the second orifice and the second fuel outlet, and the first acoustic volume and the second acoustic volume are different from one another.

14 Claims, 7 Drawing Sheets

(52) U.S. Cl.
CPC ..... *F05D 2260/964* (2013.01); *F23R 2900/00014* (2013.01)

(58) Field of Classification Search
CPC .. F05D 2240/35; F05D 2260/964; F23N 5/24; F23N 5/247
See application file for complete search history.

(56) References Cited

U.S. PATENT DOCUMENTS

| | | | | |
|---|---|---|---|---|
| 4,620,414 | A | 11/1986 | Christ | |
| 4,677,822 | A | 7/1987 | Iizuka et al. | |
| 4,724,670 | A | 2/1988 | Greer | |
| 4,901,694 | A | 2/1990 | Sakita | |
| 5,159,807 | A | 11/1992 | Forestier | |
| 5,211,004 | A | 5/1993 | Black | |
| 5,319,931 | A | 6/1994 | Beebe et al. | |
| 5,345,758 | A | 9/1994 | Bussing | |
| 5,575,144 | A | 11/1996 | Brough et al. | |
| 5,657,631 | A | 8/1997 | Androsov | |
| 5,809,769 | A | 9/1998 | Richards et al. | |
| 5,943,866 | A | 8/1999 | Lovett et al. | |
| 6,016,658 | A | 1/2000 | Willis et al. | |
| 6,164,055 | A | 12/2000 | Lovett et al. | |
| 6,625,569 | B2 | 9/2003 | James et al. | |
| 6,820,431 | B2 | 11/2004 | McManus et al. | |
| 7,278,266 | B2 | 8/2007 | Taware et al. | |
| 7,320,222 | B2 | 1/2008 | Flohr et al. | |
| 7,331,182 | B2 | 2/2008 | Graf et al. | |
| 7,337,057 | B2 | 2/2008 | Norman et al. | |
| 7,451,601 | B2 | 11/2008 | Taware et al. | |
| 7,503,177 | B2 | 3/2009 | Bland et al. | |
| 7,523,614 | B2 | 4/2009 | Tanimura et al. | |
| 7,578,130 | B1 | 8/2009 | Kraemer et al. | |
| 7,620,461 | B2 | 11/2009 | Frederick, II et al. | |
| 7,693,147 | B2 | 4/2010 | Williams et al. | |
| 7,739,999 | B2 | 6/2010 | Kang et al. | |
| 7,743,599 | B2 | 6/2010 | Taware et al. | |
| 7,805,922 | B2 | 10/2010 | Bland | |
| 7,886,545 | B2 | 2/2011 | Lacy et al. | |
| 7,908,072 | B2 | 3/2011 | Tonno et al. | |
| 7,997,083 | B2 | 8/2011 | Meadows et al. | |
| 8,112,216 | B2 | 2/2012 | Davis, Jr. et al. | |
| 8,113,000 | B2 | 2/2012 | Laster et al. | |
| 8,322,140 | B2 | 12/2012 | Kim et al. | |
| 8,966,909 | B2 | 3/2015 | Crothers et al. | |
| 9,027,349 | B2 | 5/2015 | Miura et al. | |
| 9,845,732 | B2 * | 12/2017 | Crothers | F02C 7/24 |
| 2003/0144787 | A1 | 7/2003 | Davis, Jr. et al. | |
| 2004/0083738 | A1 | 5/2004 | McManus et al. | |
| 2005/0278108 | A1 | 12/2005 | Norman et al. | |
| 2006/0041368 | A1 | 2/2006 | Williams et al. | |
| 2006/0042261 | A1 | 3/2006 | Taware et al. | |
| 2006/0107666 | A1 | 5/2006 | Kothnur | |
| 2006/0254279 | A1 | 11/2006 | Taware et al. | |
| 2007/0180831 | A1 | 8/2007 | Bland | |
| 2007/0199328 | A1 | 8/2007 | Shah et al. | |
| 2008/0010966 | A1 | 1/2008 | Taware et al. | |
| 2008/0264033 | A1 * | 10/2008 | Lacy | F23R 3/286 60/39.49 |
| 2009/0005951 | A1 | 1/2009 | Frederick et al. | |
| 2009/0005952 | A1 | 1/2009 | Tonno et al. | |
| 2009/0063003 | A1 | 3/2009 | Meadows et al. | |
| 2009/0320483 | A1 | 12/2009 | Storey et al. | |
| 2010/0170254 | A1 * | 7/2010 | Venkataraman | F02C 7/228 60/746 |
| 2010/0192578 | A1 | 8/2010 | Singh et al. | |
| 2010/0232930 | A1 | 9/2010 | Gregory | |
| 2010/0236214 | A1 | 9/2010 | Wiedenhoefer et al. | |
| 2010/0313568 | A1 | 12/2010 | Davis, Jr. et al. | |
| 2011/0048021 | A1 | 3/2011 | Slobodyanskiy et al. | |
| 2011/0048022 | A1 | 3/2011 | Singh et al. | |
| 2011/0072826 | A1 | 3/2011 | Narra et al. | |
| 2011/0162370 | A1 | 7/2011 | Kim et al. | |
| 2011/0179795 | A1 | 7/2011 | Johnson et al. | |
| 2011/0308654 | A1 | 12/2011 | Bothien et al. | |
| 2012/0006029 | A1 | 1/2012 | Bilbao et al. | |
| 2012/0131923 | A1 | 5/2012 | ELKady et al. | |
| 2012/0144832 | A1 | 6/2012 | Herbon et al. | |
| 2012/0180487 | A1 * | 7/2012 | Uhm | F23D 14/62 60/737 |
| 2013/0000312 | A1 | 1/2013 | Kodukulla et al. | |
| 2013/0014514 | A1 | 1/2013 | Romig et al. | |
| 2014/0053258 | A1 | 2/2014 | Crothers et al. | |
| 2014/0053528 | A1 | 2/2014 | Crothers et al. | |
| 2014/0060063 | A1 | 3/2014 | Boardman et al. | |
| 2014/0109587 | A1 | 4/2014 | Crothers et al. | |
| 2014/0137561 | A1 | 5/2014 | Crothers et al. | |
| 2014/0238026 | A1 | 8/2014 | Boardman et al. | |
| 2014/0238033 | A1 | 8/2014 | Crothers et al. | |
| 2014/0238041 | A1 | 8/2014 | Crothers et al. | |
| 2014/0260299 | A1 | 9/2014 | Boardman et al. | |
| 2014/0338341 | A1 | 11/2014 | Abreu | |
| 2015/0219337 | A1 | 8/2015 | Crothers et al. | |
| 2015/0260407 | A1 | 9/2015 | Crothers et al. | |
| 2015/0285508 | A1 | 10/2015 | Olson | |
| 2015/0292744 | A1 | 10/2015 | Ziminsky et al. | |
| 2016/0169520 | A1 | 6/2016 | Davis et al. | |

FOREIGN PATENT DOCUMENTS

| | | |
|---|---|---|
| EP | 2031192 | 3/2009 |
| GB | 881935 A | 11/1961 |
| JP | 2009281720 | 12/2009 |
| JP | 2012102733 | 5/2012 |

OTHER PUBLICATIONS

GB Search and Examination Report issued in connection with corresponding GB Application No. 1606510.4 dated Sep. 29, 2016.
Richards, Geo et al., "Effect of Fuel System Impedance Mismatch on Combustion Dynamics," ASME Turbo Expo 2005: Power for Land, Sea, and Air, vol. 2, Paper No. GT2005-68386, Reno, Nevada, Jun. 6-9, 2005, 11 pgs.
Spoor et al., "Mode-locking of acoustic resonators and its application to vibration cancellation in acoustic heat engines," Condensed Matter and Thermal Physics Group, Los Alamos National Laboratory, Los Alamos, New Mexico, Feb. 10, 1999, 10 pgs.
U.S. Appl. No. 14/171,001, filed Feb. 3, 2014, Crothers et al.
U.S. Appl. No. 14/192,687, filed Feb. 27, 2014, Crothers et al.
U.S. Appl. No. 14/207,041, filed Mar. 12, 2014, Crothers et al.
U.S. Appl. No. 14/276,700, filed May 13, 2014, Crothers et al.
U.S. Appl. No. 14/249,158, filed Apr. 9, 2014, Ziminsky et al.
U.S. Appl. No. 14/248,194, filed Apr. 8, 2014, Stevenson et al.
U.S. Appl. No. 14/288,875, filed May 28, 2014, Crothers et al.
U.S. Appl. No. 14/288,974, filed May 28, 2014, Crothers et al.
U.S. Appl. No. 14/316,616, filed Jun. 26, 2014, Crothers et al.
U.S. Appl. No. 14/659,399, filed Mar. 16, 2015, DiCintio et al.
U.S. Appl. No. 14/048,252, filed Oct. 8, 2013, Crothers et al.
U.S. Appl. No. 14/170,702, filed Feb. 3, 2014, Day et al.
U.S. Appl. No. 14/170,710, filed Feb. 3, 2014, Carnell Jr. et al.
U.S. Appl. No. 14/170,716, filed Feb. 3, 2014, Crothers et al.
U.S. Appl. No. 14/170,729, filed Feb. 3, 2014, Crothers et al.
U.S. Appl. No. 14/170,738, filed Feb. 3, 2014, Crothers et al.
U.S. Appl. No. 14/154,925, filed Jan. 14, 2014, Aphale et al.
GB Office Action dated Aug. 29, 2017, in connection with the corresponding GB Application No. 1606510.4.

* cited by examiner

SYSTEMS AND METHODS FOR CONTROL OF COMBUSTION DYNAMICS IN COMBUSTION SYSTEM

BACKGROUND

The subject matter disclosed herein relates generally to gas turbine systems, and more particularly, to systems and methods for reducing combustion dynamics, and more specifically, for reducing modal coupling of combustion dynamics within a gas turbine engine.

Gas turbine systems generally include a gas turbine engine having a compressor section, a combustor section, and a turbine section. The combustor section may include one or more combustors (e.g., combustion cans), each combustor having a primary combustion system and a secondary combustion system (e.g., late lean injection (LLI) system) downstream from the primary combustion system. A fuel and/or air mixture may be routed into the primary and secondary combustion systems through fuel nozzles, and each combustion system may be configured to combust the mixture of the fuel and air to generate hot combustion gases that drive one or more turbine stages in the turbine section.

The generation of the hot combustion gases can create a variety of combustion dynamics, which occur when the combustor acoustic oscillations interact with the flame dynamics (also known as the oscillating component of the heat release), to result in a self-sustaining pressure oscillation in the combustor. Combustion dynamics can occur at multiple discrete frequencies or across a range of frequencies, and can travel both upstream and downstream relative to the respective combustor. For example, the pressure waves may travel downstream into the turbine section, e.g., through one or more turbine stages, or upstream into the fuel system. Certain components of the turbine system can potentially respond to the combustion dynamics, particularly if the combustion dynamics generated by the individual combustors exhibit an in-phase and coherent relationship with each other, and have frequencies at or near the natural or resonant frequencies of the components. In the context of combustion dynamics, "coherence" refers to the strength of the linear relationship between two dynamic signals, and is strongly influenced by the degree of frequency overlap between them. In the context of combustion dynamics, "coherence" is a measure of the modal coupling, or combustor-to-combustor acoustic interaction, exhibited by the combustion system.

Accordingly, a need exists to control the combustion dynamics, and/or modal coupling of the combustion dynamics, to reduce the possibility of any unwanted sympathetic vibratory response (e.g., resonant behavior) of components in the turbine system.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a gas turbine engine. The gas turbine engine includes a first combustor having a first fuel injector and a second combustor having a second fuel injector. The gas turbine engine further includes a first fuel conduit extending from a first orifice to a first fuel outlet of the first fuel injector. The first fuel conduit has a first acoustic volume between the first orifice and the first fuel outlet. The gas turbine engine further includes a second fuel conduit extending from a second orifice to a second fuel outlet of the second fuel injector. The second fuel conduit has a second acoustic volume between the second orifice and the second fuel outlet, and the first acoustic volume and the second acoustic volume are different from one another.

In a second embodiment, a system includes a first combustor of a gas turbine system. The first combustor includes a first fuel injector having a first fuel outlet and a second fuel injector having a second fuel outlet. The first combustor further includes the first fuel conduit extending from a first orifice to the first fuel outlet of the first fuel injector. The first fuel conduit has a first conduit geometry between the first orifice and the first fuel outlet and the first orifice has a first orifice geometry. The first combustor further includes a second fuel conduit extending from a second orifice to the second fuel outlet of the second fuel injector. The second fuel conduit has a second conduit geometry between the second orifice and the second fuel outlet and the second orifice has a second orifice geometry. The first conduit geometry and the second conduit geometry are different from one another, or the first orifice geometry and the second orifice geometry are different from one another, or a combination thereof.

In a third embodiment, a system includes a first fuel conduit extending from a first orifice to a first fuel outlet of a first fuel injector of a gas turbine engine. The first fuel conduit has a first conduit geometry between the first orifice and the first fuel outlet, and the first orifice has a first orifice geometry. The system further includes a second fuel conduit extending from a second orifice to a second fuel outlet of a second fuel injector of the gas turbine engine. The second fuel conduit has a second conduit geometry between the second orifice and the second fuel outlet. The second orifice has a second orifice geometry different from the first orifice geometry, or the second conduit geometry is different from the first conduit geometry.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
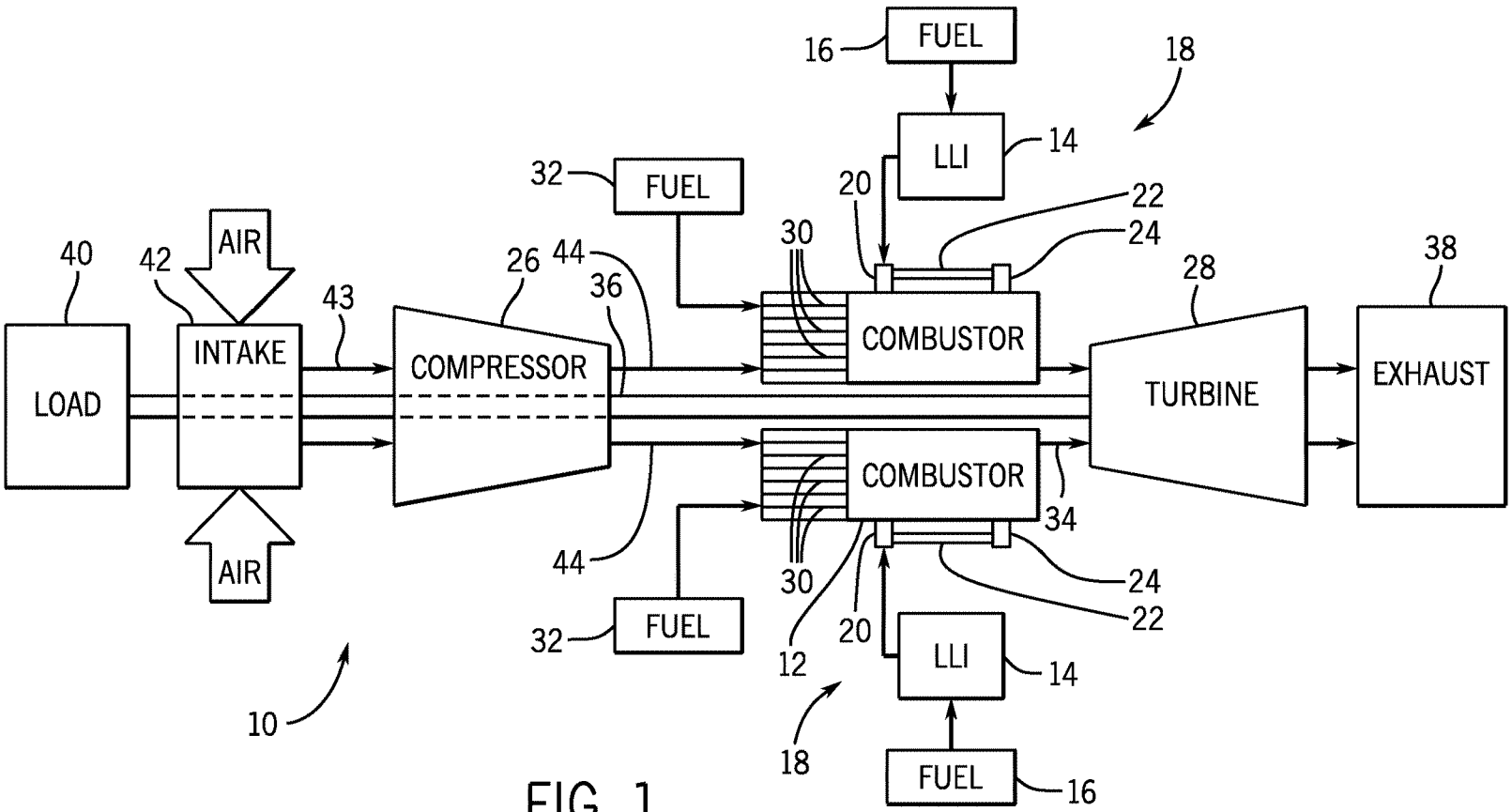
FIG. 1 is a schematic of an embodiment of a gas turbine system having a plurality of combustors, where each combustor is equipped with a late lean injection (LLI) fuel circuit.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed towards reducing combustion dynamics and/or modal coupling of combustion dynamics, to reduce unwanted vibratory responses in downstream components of a gas turbine system and/or the combustors themselves. A gas turbine combustor (or combustor assembly) may generate combustion dynamics due to the combustion process, characteristics of intake fluid flows (e.g., fuel, oxidant, diluent, etc.) into the combustor, and various other factors. The combustion dynamics may be characterized as pressure fluctuations, pulsations, oscillations, and/or waves at certain frequencies. The fluid flow characteristics may include velocity, pressure, fluctuations in velocity and/or pressure, variations in flow paths (e.g., turns, shapes, interruptions, etc.), or any combination thereof. Collectively, the combustion dynamics can potentially cause vibratory responses and/or resonant behavior in various components upstream and/or downstream from the combustor, as well as the combustors themselves. For example, the combustion dynamics (e.g., at certain frequencies, ranges of frequencies, amplitudes, combustor-to-combustor phases, etc.) can travel both upstream and downstream in the gas turbine system. If the gas turbine combustors, upstream components, and/or downstream components have natural or resonant frequencies that are driven by these pressure fluctuations (i.e. combustion dynamics), then the pressure fluctuations can potentially cause vibration, stress, fatigue, etc. The components may include combustor liners, combustor flow sleeves, combustor caps, fuel nozzles, turbine nozzles, turbine blades, turbine shrouds, turbine wheels, bearings, fuel supply assemblies, or any combination thereof. The downstream components are of specific interest, as they are more sensitive to combustion tones that are in-phase and coherent. Thus, reducing coherence, altering phase and/or reducing the amplitudes of the combustion dynamics specifically reduces the possibility of unwanted vibrations in downstream components. One way to reduce the coherence of the combustion dynamics among the combustors is to alter the frequency relationship between two or more combustors, diminishing any combustor-to-combustor coupling. As the combustion dynamics frequency in one combustor is driven away from that of the other combustors, modal coupling of combustion dynamics is reduced, which, in turn, reduces the ability of the combustor tone to cause a vibratory response in downstream components. An alternate method of reducing modal coupling is to reduce the constructive interference of the fuel nozzles within the same combustor, by introduction of a phase delay between the fuel nozzles, reducing the amplitudes in each combustor, and potentially preventing or reducing combustor-to-combustor coupling. Furthermore, introducing a phase lag between the combustors, or otherwise altering the phase relationship between two or more combustors may also help to prevent or reduce unwanted vibrations in the gas turbine system.

As discussed in detail below, the disclosed embodiments may vary the physical characteristics of a pre-orifice within a fuel line of a fuel supply assembly (e.g., late lean injection (LLI) fuel circuit) to modify the fuel system acoustic impedance, which may lead to combustion dynamics frequencies in one or more combustors that are different, phase shifted, smeared or spread out over a greater frequency range, or any combination thereof, relative to any resonant frequencies of the components in the gas turbine system. As noted above, a gas turbine system may include one or more combustor assemblies (e.g., combustor cans, combustors, etc.), and each combustor may be configured with a primary combustion zone and a secondary combustion zone. Specifically, in some embodiments, the secondary combustion zone may include an LLI fuel circuit configured to route a secondary fuel into a secondary combustion zone for combustion. In certain embodiments, each LLI fuel circuit includes one or more fuel lines extending along either the liner or the flow sleeve of the combustor, and each fuel line is configured to provide a secondary fuel to one or more fuel injectors that route the secondary fuel into the secondary combustion zone. In particular, each of the one or more LLI fuel lines may include one or more pre-orifices through which the fuel flows in the LLI fuel circuit prior to arriving at the LLI fuel nozzles, where the fuel is injected into the combustor through one or more post-orifices. The fuel system acoustic impedance of the fuel nozzles is defined by the geometry of the pre-orifice, the geometry of the post-orifice and the volume between the pre and post-orifice. Accordingly, varying the position of the pre-orifice within the LLI fuel circuit adjusts the volume between the pre and post orifice, to adjust the fuel system acoustic impedance of one or more fuel nozzles. In addition, altering the size, shape and/or number of holes in the pre-orifice may also alter the fuel system acoustic impedance of one or more fuel nozzles.

In certain embodiments, the physical characteristics (e.g., position, sizing, shape, location, effective area, etc.) of the pre-orifice of each fuel line within the LLI fuel circuit of a single combustor may be different from the physical characteristics of the pre-orifice of another fuel line within the same LLI fuel circuit. For example, the location of the pre-orifice along the LLI fuel line may be shifted, so that it is closer or further away from the post-orifice, thus changing the acoustic volume between the pre and post orifices, thereby altering the fuel system impedance. By further example, the location of the pre-orifice relative to the post-orifice may be shifted relative to other fuel lines of the same combustor, thus changing the acoustic volume between the pre and post orifices and thereby altering the fuel system impedance. Further, in certain embodiments, the physical characteristics of the pre-orifices of the one or more fuel lines within a single combustor may be different from the physical characteristics of the pre-orifices of one or more fuel lines within another (e.g., adjacent, alternating) combustor within the gas turbine system. For example, the location of the pre-orifice relative to the post-orifice along the LLI fuel lines of a first combustor may be shifted when compared to the location of the pre-orifice relative to the post-orifice of another combustor (e.g., an adjacent combustor), thereby changing the acoustic volume between the pre and post orifices and thus altering the fuel system impedance between different combustors within the gas turbine system.

In some embodiments, by varying the physical characteristics of the pre-orifice (e.g., location, size, position, shape, effective area, etc.) of one or more fuel lines within the LLI fuel circuit of the combustor, the magnitude and phase of the fuel system impedance for the fuel nozzle will be changed, which affects the fluctuating component of the heat release, and therefore the combustion dynamics of the combustor. Varying the fuel system impedance between two or more fuel lines within a combustor by varying the physical characteristics of two or more pre-orifices results in different fuel system acoustic impedance magnitudes and phases for the different fuel nozzles. The difference in the phase of the fuel system impedance between the fuel nozzles results in destructive interference of the heat release fluctuations associated with each of the fuel nozzles, reducing the amplitude of the combustion dynamics, and potentially smearing the frequency content of the combustion dynamics across a broader frequency range.

In some embodiments, the physical characteristics of the pre-orifice (e.g., location, size, position, shape, effective area, etc.) of each fuel line within a particular combustor may be the same, but may be varied compared to the pre-orifices of fuel lines within other combustors within the system. Varying the physical characteristics of the pre-orifices among the fuel lines of various combustors may vary the fuel system acoustic impedance and therefore, combustion dynamics, from combustor to combustor in a manner to reduce the combustion dynamics amplitudes, alter the combustion dynamics frequency, alter the phase of the combustion dynamics, and/or reduce modal coupling of the combustion dynamics among the plurality of gas turbine combustors. In some embodiments, the physical characteristics of the pre-orifice may be varied within a particular combustor, as well as among one or more combustors of the system in order to reduce dynamic amplitudes as well as coherence within and/or among the combustors of the system. For example, the physical characteristics of the pre-orifices among the combustors may be varied according to various patterns or groupings, as further explained below. Indeed, such variations may help reduce the amplitudes of the combustion dynamics and/or reduce the possibility of modal coupling of the combustors, particularly at frequencies that are aligned with resonant frequencies of the components of the gas turbine system.

Figure 2:
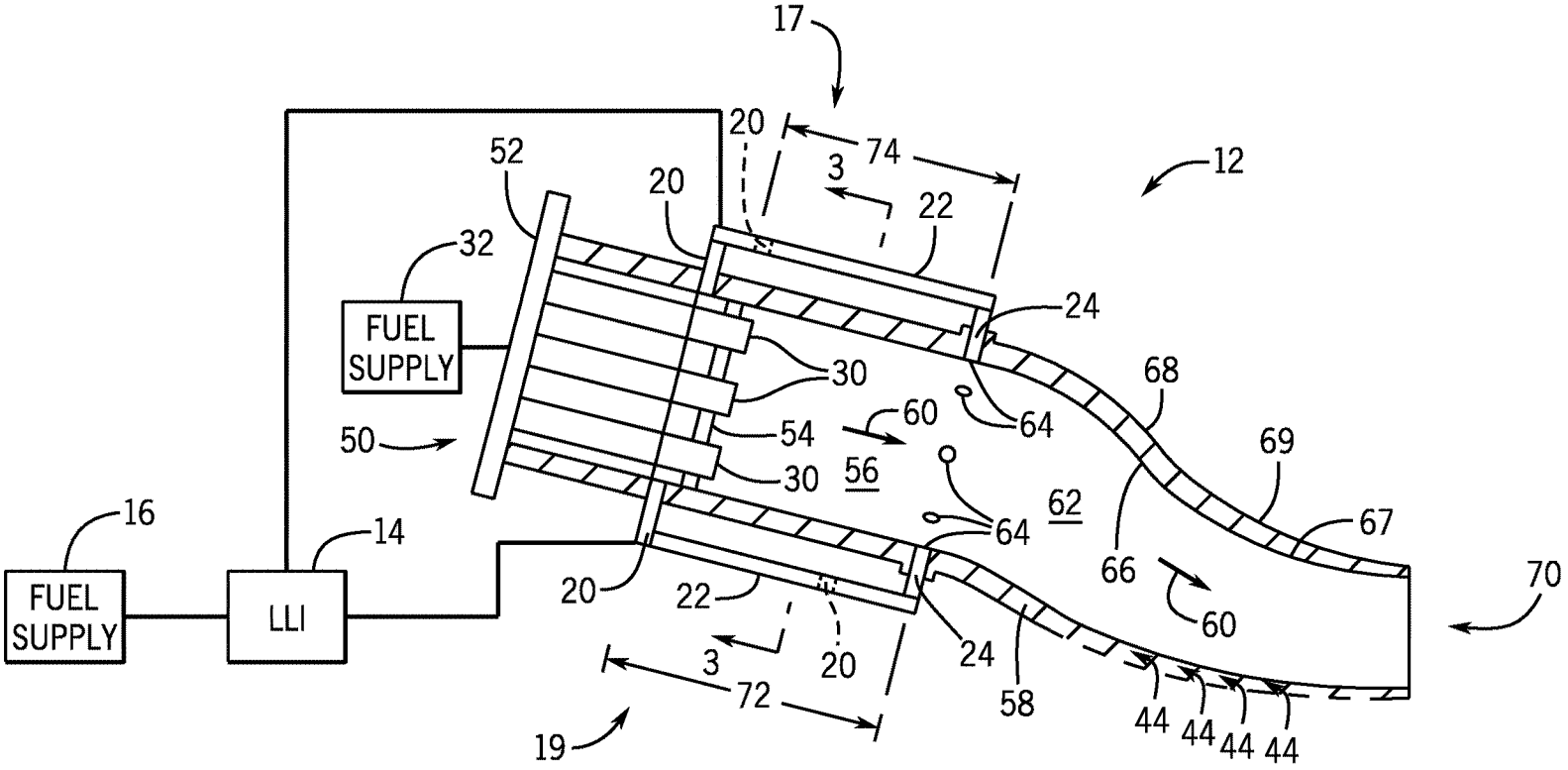
FIG. 2 is a schematic of an embodiment of one of the combustors of FIG. 1, including one or more fuel lines within the LLI fuel circuit, where the position of a pre-orifice within each fuel line varies from one fuel line to another to help control combustion dynamics and/or modal coupling of combustion dynamics to reduce the possibility of unwanted vibratory responses in downstream components.

With the forgoing in mind, FIG. 1 is a schematic of an embodiment of a gas turbine system 10 having a plurality of combustors 12 and a fuel supply circuit 14, such as an LLI fuel circuit 14. In particular, each combustor 12 may be associated with a fuel circuit 14 that routes a liquid and/or gas fuel into the combustors 12. For example, the fuel circuit 14 may be configured to route a liquid and/or gas secondary fuel 16 (e.g., secondary fuel 16, second fuel 16) to one or more fuel supply systems 18 of the combustor 12. Each fuel supply system 18 of the combustor 12 includes a pre-orifice 20 disposed along a fuel conduit 22 (as illustrated in FIG. 2) of the combustor 12, and a post-orifice 24 disposed along the fuel conduit 22, and generally disposed within a fuel nozzle, such as a secondary fuel nozzle (as illustrated in FIG. 2) of the combustor 12. The secondary fuel 16 may be provided to the combustor 12 from the fuel circuit 14. From the fuel circuit 14, the fuel flows through the pre-orifice 20 in the fuel conduit 22, and may be then routed through the secondary fuel nozzle 64 via one or more post-orifices 24. As noted above, varying the geometries of the pre-orifices 20 as described above may adjust the fuel system acoustic impedance of one or more of the secondary nozzles 64, thereby leading to a shift in combustion dynamics frequency and/or greater variations in the frequency content of the resulting combustion dynamics, and/or reduced amplitudes of the combustion dynamics.

The gas turbine system 10 includes the one or more combustors 12 having the fuel line systems 18, a compressor 26, and a turbine 28. The combustors 12 include primary fuel nozzles 30 which route a primary fuel 32 (e.g., liquid fuel and/or a gas fuel, a first fuel, etc.) into the combustors 12 for combustion within the primary combustion zone. Likewise, the combustors 12 include secondary fuel nozzles 64 (as illustrated in FIG. 2) which route a secondary fuel 16 into the combustors 12 for combustion within the secondary combustion zone. In particular, each combustor 12 is associated with the LLI fuel circuit 14 configured to provide the secondary fuel 16 to the one or more secondary fuel nozzles 64 via the one or more fuel conduits 22. The combustors 12 ignite and combust an air-fuel mixture, and then the hot combustion gases 34 are passed into the turbine 28. The turbine 28 includes turbine blades that are coupled to a shaft 36, which is also coupled to several other components throughout the system 10. As the combustion gases 34 pass through the turbine blades in the turbine 28, the turbine 28 is driven into rotation, which causes the shaft 36 to rotate. Eventually, the combustion gases 34 exit the turbine system 10 via an exhaust outlet 38. Further, the shaft 36 may be coupled to a load 40, which is powered via rotation of the shaft 36. For example, the load 40 may be any suitable device that may generate power via the rotational output of the turbine system 10, such as a power generation plant or an external mechanical load. For instance, the load 40 may include an electrical generator, a propeller of an airplane, and so forth.

In an embodiment of the turbine system 10, compressor blades are included as components of the compressor 26. The blades within the compressor 26 are coupled to the shaft 36, and will rotate as the shaft 36 is driven to rotate by the turbine 28, as described above. The rotation of the blades within the compressor 26 compresses air 43 from an air intake 42 into pressurized air 44. The pressurized air 44 is then fed into the primary fuel nozzles 30 of the combustors 12. The primary fuel nozzles 30 mix the pressurized air 44 and fuel to produce a suitable mixture ratio for combustion (e.g., a combustion that causes the fuel to more completely burn) so as not to waste fuel or cause excess emissions.

Figure 5:
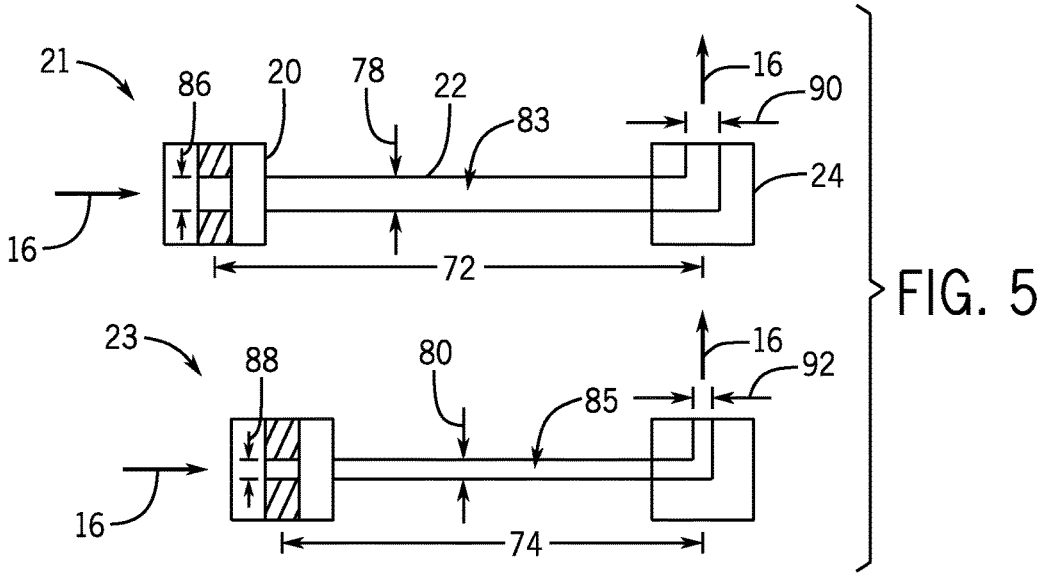
FIG. 5 is a schematic of an embodiment of two fuel supply systems coupled to a combustor of FIG. 4.
Figure 6:
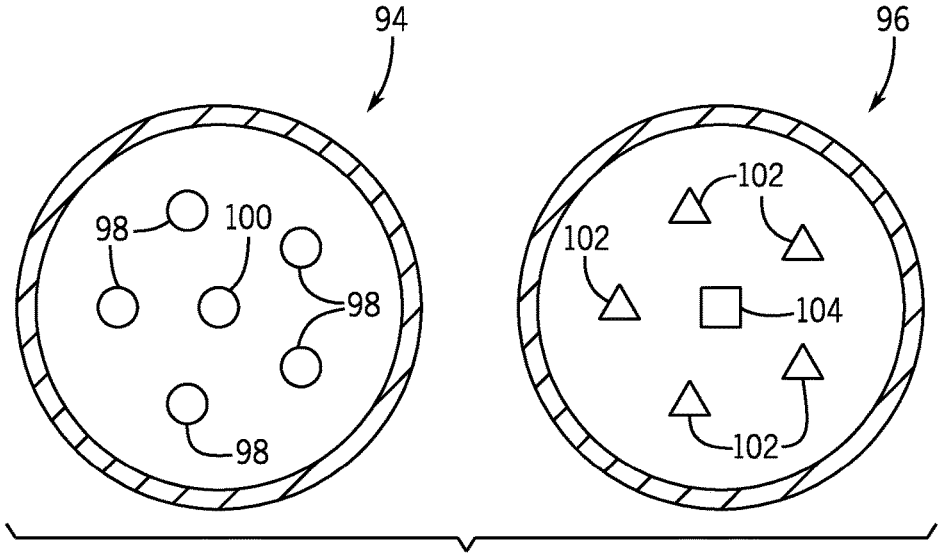
FIG. 6 is a schematic of an embodiment of pre-orifices (e.g., a first pre-orifice and a second pre-orifice) of the two fuel supply systems of FIG. 5.
Figure 7:
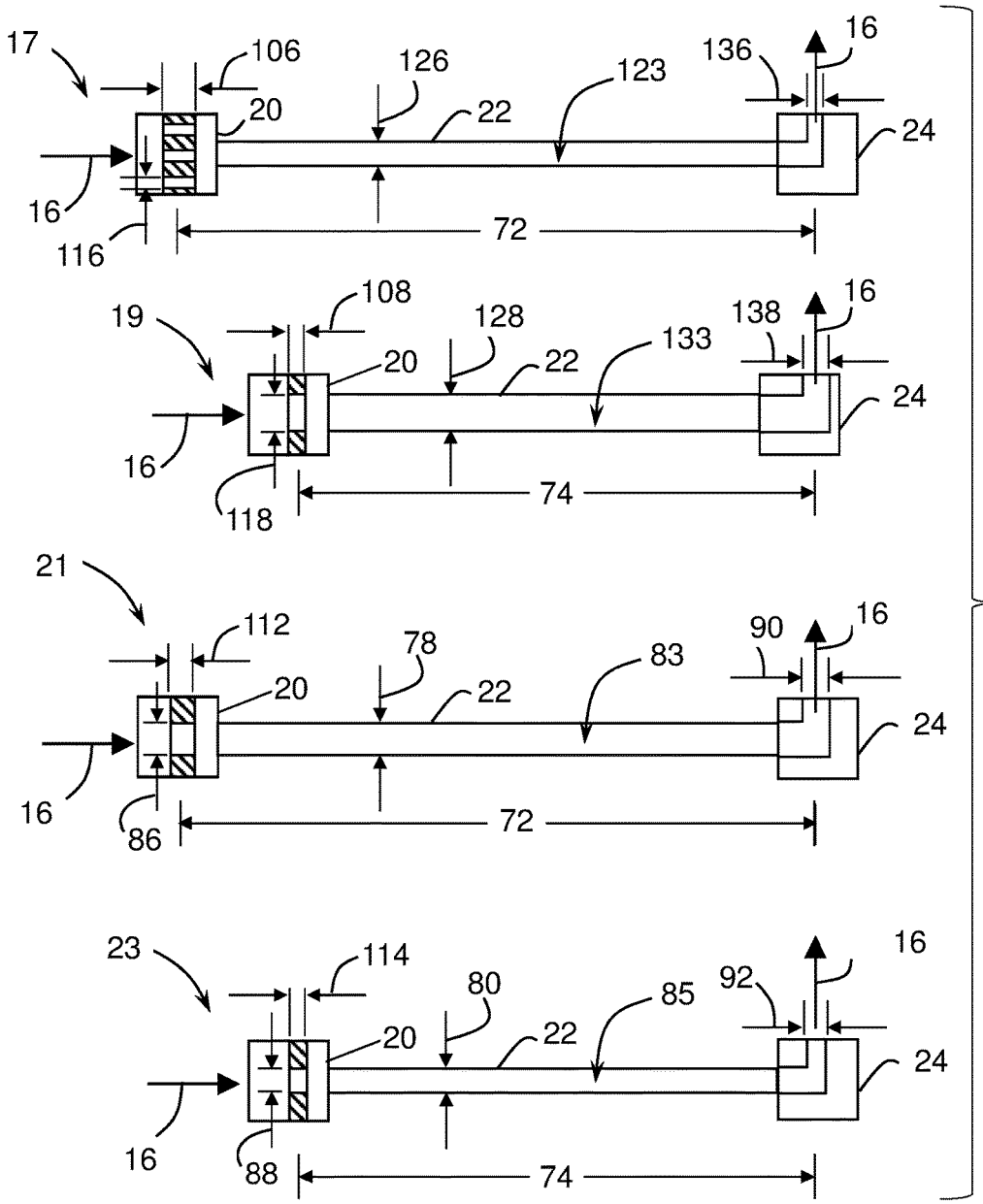
FIG. 7 is a schematic of an embodiment of a first fuel supply system and a second fuel supply system coupled to a first combustor of FIG. 4 and a third fuel supply system and a fourth fuel supply system coupled to a second combustor of FIG. 4.
Figure 8:
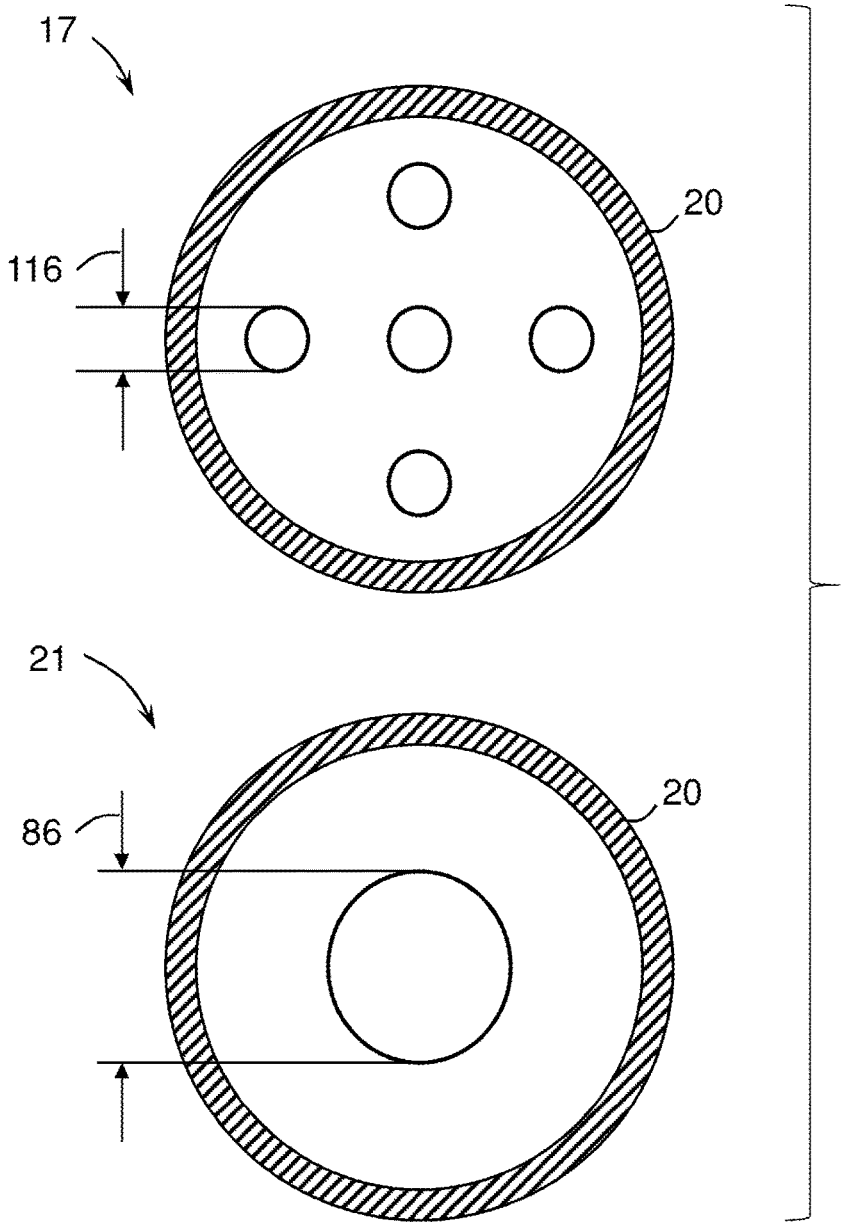
FIG. 8 is a schematic of an embodiment of exemplary pre-orifices, as may be associated with the first fuel supply system and the third fuel supply system of FIG. 7.

As discussed in further detail below, the physical characteristics (e.g., position, size, location, shape, effective area, etc.) of the pre-orifice 20 may vary between different fuel conduits 22 of the same combustor 12 (as shown in FIGS. 5 and 6), and/or may vary between different fuel conduits 22 of different combustors 12 within the same gas turbine system 10 (as shown in FIGS. 7 and 8). As noted above, changing the physical characteristics of the pre-orifice 20 and/or the volume between the pre-orifice and the post-orifice 24 between different fuel conduits 22 of the same combustor 12 may help vary the fuel system acoustic impedance, and thereby help reduce unwanted vibratory responses within the combustor and/or in downstream components of the system 10. Likewise, changing the physical characteristics of the pre-orifice 20 and/or the volume between the pre-orifice and the post-orifice 24 between fuel conduits 22 of different combustors 12 may help vary fuel system acoustic impedances, thereby helping to reduce amplitudes and/or coherence of the combustion dynamics, and/or alter the phase of the combustion dynamics.

In some embodiments, changes in the physical characteristics of the pre-orifice 20 for a specific fuel nozzle may change the effective area and/or the pressure ratio for that fuel nozzle, which in turn may result in variations of the mass flow of the secondary fuel 16 entering the combustor 12. For example, the shape of the pre-orifice 20 (e.g., round, oval, square, polygonal, etc.) may be varied between and/or among different combustors 12 to vary the effective area and/or the pressure ratio of the pre-orifice 20 which would vary the mass flow of secondary fuel 16 entering the combustor 12. As a further example, shifting the location of the pre-orifice 20 relative to the post-orifice 24 (e.g., closer to the post-orifice 24 or away from the post-orifice 24) may increase or decrease the acoustic volume between the pre-orifice 20 and the post-orifice 24, thereby resulting in a phase delay between one or more secondary fuel nozzles 64, and causing destructive interference of the equivalence ratio fluctuations generated by the fuel nozzles 64. In this manner, changing the physical characteristics may result in variations between the heat release of the LLI injectors within the combustor, thereby increasing the amount of temporal variation in the dynamic frequency content in the flame region, and/or increasing the destructive interference of the dynamic frequency content in the flame region, which may result in reducing the amplitude of the combustor tones and/or the coherence of the combustion dynamics.

In some embodiments, the size and/or shape of the pre-orifice 20 may vary between different fuel conduits 22 of the same combustor 12 (as shown in FIGS. 5 and 6), and/or may vary between different fuel conduits 22 of different combustors 12 within the same gas turbine system 10 (as shown in FIGS. 7 and 8). Further, while variations on the pre-orifice 20 are described, it should be noted that changes in the physical characteristics of the post-orifice 24 (e.g., size, shape, location, position, effective area, etc.) may also help reduce the amplitudes of the combustion dynamics within the system 10. Likewise, varying the physical characteristics of the fuel conduit 22 (e.g., length, width, circumference, diameter, effective area, etc.) in order to change the distance and the acoustic volume between the pre-orifice 20 and the post-orifice 24 may help reduce unwanted vibratory responses within the gas turbine system 10.

FIG. 2 is a schematic view of an embodiment of one of the combustors 12 depicted in FIG. 1, where the combustor 12 includes the fuel supply system 18 (e.g., a first fuel supply system 17, a second fuel supply system 19, etc.) having the pre-orifice 20 and the post-orifice 24 disposed along the fuel conduit 22. It should be noted in certain embodiments; the pre-orifice 20 may be disposed anywhere along the fuel conduit 22, as illustrated in FIG. 2. In particular, the physical characteristics (e.g., location, size, shape, dimensions, position) of the components of the fuel supply system 18 (e.g., the pre-orifice 20, the fuel conduit 22, and the post-orifice 24) may be varied between different fuel supply systems 18 of the combustor 12. For example, the position of the pre-orifice 20 relative to the post-orifice 24 (and thus intermediate distance and volume) of the first fuel supply system 17 may be different than the position of the pre-orifice 20 (and thus intermediate distance and volume) relative to the post-orifice 24 of the second fuel supply system 19, as described in detail below. Such variations may vary the fuel system acoustic impedance of the associated secondary fuel nozzles 64 leading to combustion dynamics frequencies that are different and/or phase-shifted between the fuel nozzles 64 and/or between combustors 12, thereby reducing unwanted vibratory responses in the gas turbine system 10. For example, maximum destructive interference between the fuel nozzles 64 occurs when the phase delay between the fuel nozzles 64 is approximately 180 degrees.

The combustor 12 includes a head end 50 having an end cover 52, a combustor cap assembly 54, and a primary combustion zone 56. The end cover 52 and the combustor cap assembly 54 may be configured to support the primary fuel nozzles 30 in the head end 50. In the illustrated embodiment, the primary fuel nozzles 30 route the primary fuel 32 to the primary combustion zone 56. The combustor 12 includes an outer wall (e.g., flow sleeve 68) disposed circumferentially about an inner wall (e.g., combustion liner 66). The inner wall may also include a transition piece 69, which generally converges towards a first stage of the turbine 28. An impingement sleeve 67 is disposed circumferentially about the transition piece 69. Further, the primary fuel nozzles 30 receive the pressurized air 44 from the annulus 58 (e.g., between transition piece 69 and impingement sleeve 67 and between liner 66 and flow sleeve 68) of the combustor 12 and combine the pressurized air 44 with the primary fuel 32 to form an air/fuel mixture that is ignited and combusted in the primary combustion zone 56 to form combustion gases (e.g., exhaust).

The combustion gases flow in a direction 60 to a secondary combustion zone 62. The LLI fuel circuit 14 provides the secondary fuel 16 which flows through the pre-orifice 20 in the fuel conduit 22 to the post-orifice 24. In particular, the post-orifice 24 in the secondary fuel nozzles 64 receive the secondary fuel 16 from the fuel conduit 22, and route the secondary fuel 16 into the secondary combustion zone 62 to the stream of combustion gases. Further, the secondary fuel nozzles 64 may receive the pressurized air 44 from the annulus 58 of the combustor 12 and combine the pressurized air 44 with the secondary fuel 16 to form an air/fuel mixture that is ignited and combusted in the secondary combustion zone 62 to form the combustion gases. More specifically, the pressurized air 44 flows through the annulus 58 between a transition piece 69 and an impingement sleeve 67, and then between a liner 66 and a flow sleeve 68 of the combustor 12 to reach the head end 50. The combustion gases flow in the direction 60 through the transition piece 69 of the combustor 12, and pass into the turbine 28, as noted above.

As described above, combustion dynamics (e.g., generation of hot combustion gases) within the primary combustion zone 56 and the secondary combustion zone 62 may lead to unwanted vibratory responses within the combustor 12. In may be helpful to reduce combustion dynamics within or among the combustors 12 to help reduce unwanted vibratory responses. Accordingly, in some embodiments, varying the physical characteristics of the pre-orifice within and/or among the combustors 12 may help reduce vibratory responses in the gas turbine system 10, and minimize vibrational stress, wearing, performance degradation, or other undesirable impacts to the components of the gas turbine system 10 (e.g., turbine blades, turbine shrouds, turbine nozzles, exhaust components, combustor transition piece, combustor liner, etc.).

In some embodiments, the position of the pre-orifice 20 relative to the post-orifice 24 (and thus the intermediate distance and volume) may be varied between the fuel supply systems 18 of the combustor 12, such that the pre-orifice 20 is shifted along the fuel conduit 22 to be closer to or further away from the post-orifice 24 and the secondary fuel nozzles 64. For example, a first distance 72 between the pre-orifice 20 and the post-orifice 24 of the first fuel supply system 17 may be different (e.g., longer, shorter, greater, smaller, etc.) than a second distance 74 between the pre-orifice 20 and the post-orifice 24 of the second fuel supply system 19. Indeed, the distances may vary or may be configured to vary based on the location where the pre-orifice 20 is disposed along the fuel conduit 22. In certain embodiments, varying the distance 72, 74 between the pre-orifice 20 and the post-orifice 24 may be done by increasing or decreasing the length of the fuel conduit 22 upstream and downstream of the pre-orifice via one or more sections of flanged tubing. In certain embodiments, the length of the fuel conduits 22 may be the same between the fuel supply systems 18, but the location of the pre-orifices 20 disposed along the fuel conduit 22 may vary between the fuel supply systems 28. Indeed, varying the distance (e.g., the first distance 72 and the second distance 74 of the pre-orifice 20 relative to the post-orifice 24) between the fuel supply systems 18 may result in phase delays between the fuel supply systems 18, leading to destructive interference of the heat release fluctuations of the fuel nozzles 64 associated with each fuel supply system 18, thereby reducing the amplitude of the combustor tones and possibly the coherence of the combustion dynamics.

Figure 3:
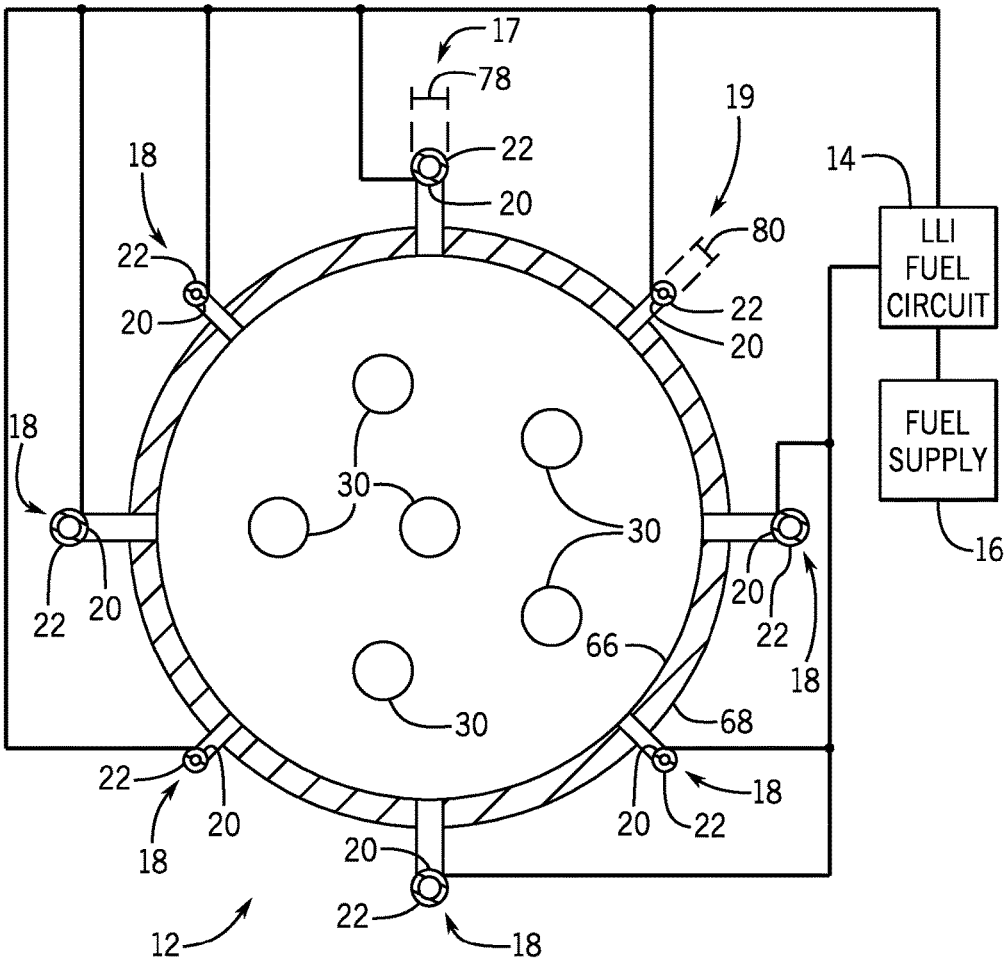
FIG. 3 is a cross-sectional schematic of an embodiment of a cross-sectional view of the combustor of FIG. 2, taken along line 3-3, illustrating the one or more fuel lines configured to route a secondary fuel from the pre-orifice to a post-orifice.

Further, in some embodiments, physical characteristics (e.g., position, location, size, shape, dimensions, effective area, etc.) of other components of the fuel supply system 18 may vary between different fuel supply systems 18 (e.g., the first fuel supply system 17 and the second fuel supply system 19), as further described with respect to FIG. 3. For example, the size and/or effective area of the pre-orifice 20 or the post-orifice 24 (e.g., diameter of the opening of the pre-orifice 20 or the post-orifice 24), the shape of the pre-orifice 20 or the post-orifice 24 opening (e.g., oval, circular, rectangular, any geometric shape, etc.), the angle of pre-orifice 20 or the post-orifice 24 opening (e.g., slanted upward at an angle, slanted downward at an angle, etc.), and so forth may vary between the fuel supply systems 18. Further, in some embodiments, the pre-orifice 20 and the post-orifice 24 may be an array or pattern of holes. In such embodiments, the size, the shape, the pattern and/or arrangement of the pre-orifice 20 holes and the post-orifice 24 holes may vary between different fuel conduits 22 of the combustor 12. In some embodiments, the pre-orifice 20 and/or the post-orifice 24 may vary among the plurality of combustors 12 (e.g., 2, 3, 4, 5, 6, 7, 8, 9, 10, or more combustors 12) with different diameters, shapes, sizes, etc.

In addition, the physical characteristics of the fuel conduit 22 may also vary between different fuel conduits 22 of the combustor 12. For example, in addition to varying the length (e.g., the first distance 72 or the second distance 74) of the fuel conduits 22, the disclosed embodiments may also vary the diameter of the fuel conduit 22, and so forth. Indeed, one or more physical characteristics of the disclosed embodiments also may vary each component within the fuel supply system 18 between different fuel supply systems 18 of the combustor 12, such that the combustion dynamics at each secondary fuel nozzle 64 are different (in terms of phase and/or frequency) to help reduce unwanted vibratory responses within the gas turbine system 10.

Figure 4:
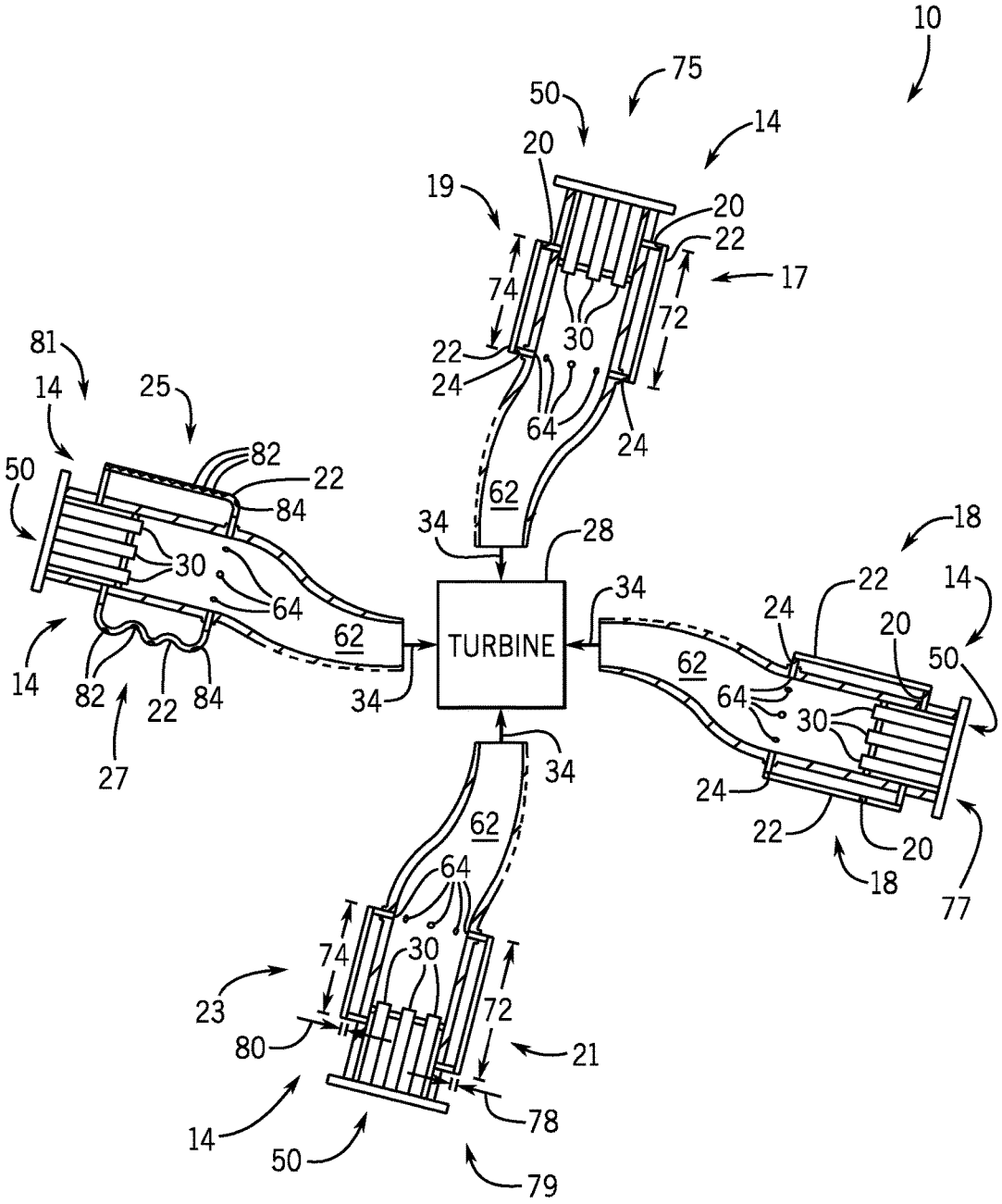
FIG. 4 is a schematic of an embodiment of the gas turbine system of FIG. 1, illustrating a plurality of combustors each having one or more fuel supply systems.

In some embodiments, the dynamic amplitudes as well as coherence may be reduced between different combustors 12 of the system 10 by varying the physical characteristics of the pre-orifices among the combustors 12, as further described with respect to FIG. 4. For example, while the position of the pre-orifice 22 relative to the post-orifice 24 may be the same among the fuel supply systems 18 of a single combustor 12, the position of the pre-orifice 22 relative to the post-orifice 24 may be varied between fuel supply systems 18 of different combustors 12 within the system 10. Further, the physical characteristics (e.g., size, position, shape, location, dimensions, effective area, etc.) of the components of the fuel supply system 18 (e.g., the pre-orifice 20, the fuel conduit 22, the post-orifice 24) may vary between different combustors 12 of the system 10. In some embodiments, the physical characteristics of the components of the fuel supply system 28 may vary between fuel lines 18 of the same combustor 12, as well as between fuel lines 18 of different combustors 12.

FIG. 3 is a cross-sectional view of an embodiment of the combustor 12 depicted in FIG. 2, illustrating one or more fuel supply systems 18 each receiving the secondary fuel 16. Particularly, the secondary fuel 16 is routed through the pre-orifice 20, through the fuel conduit 22, and then through the post-orifice 24, of the secondary fuel nozzles 64 (as illustrated in FIG. 2). The fuel conduits 22, composed of one or more sections of flanged tubing, extend along the outside of the flow sleeve 68 of the combustor 12, as illustrated in FIG. 2, such that the fuel conduits 22 route the secondary fuel 16 from the pre-orifice 20 to the one or more secondary fuel nozzles 64. While the illustrated embodiment depicts the fuel conduits 22 with alternating large and small diameters, as further explained below, it should be noted that in other embodiments, the fuel conduits 22 may have any sized diameters.

In particular, the physical characteristics of the components of each fuel supply system 18 within the combustor 12 may vary, such that the size, shape, dimensions, configuration, position, location, and so forth, are different between the fuel supply systems 18 of a single combustor 12 and/or between adjacent combustors 12. For example, in the illustrated embodiment, the size of the pre-orifice 20 and the fuel conduit 22 is different for each adjacent fuel supply system 18. For example, a first diameter 78 of the fuel conduit 22 of the first fuel supply system 17 is greater than a second diameter 80 of the fuel conduit 22 of the second fuel supply system 19. It should be noted that while the illustrated embodiment depicts alternating and/or adjacent fuel supply systems 18 (e.g., the first supply system 17 and the second fuel supply system 19) having variations in the physical characteristics of the pre-orifice 20 and/or the fuel conduit 22, in other embodiments, any combination and/or pattern of fuel supply systems 18 may have variations in the physical characteristics of the components of the fuel supply systems 18. Further, there may be one or more physical characteristics variations between any two fuel supply systems 18. As noted above, the illustrated embodiment depicts fuel conduits 22 that alternate between the first diameter 78 and the second diameter 80. In other embodiments, the diameter size of the fuel conduits 22 may alternate between 2, 3, 4, 5, 6, 7, 8, 9, 10 or more different sizes, shapes, etc.

FIG. 4 is a schematic of an embodiment of the gas turbine system 10 of FIG. 1, depicting a plurality of combustors 12 each having one or more fuel supply systems 18. In particular, each fuel supply system 18 includes various components such as the pre-orifice 20, the fuel conduit 22, and the post-orifice 24, and the physical characteristics (e.g., size, position, dimensions, location, shape, geometric characteristics, etc.) of one or more components of the fuel supply system 18 may vary within and/or between the one or more combustors 12 of the system 10. As noted above, variations within the components of the fuel supply systems 18 of a single combustor 12 and/or between the components of fuel supply systems 18 of one or more combustors 12 result in changes to the fuel system acoustic impedance for one or more fuel nozzles 64, thereby leading to a shift in combustion dynamics frequency and/or greater variations in the frequency content of the resulting combustion dynamics, and/or reduced amplitudes of the combustion dynamics, and/or differences in phase of the combustion dynamics between two or more combustors 12. In particular, the illustrated embodiment depicts the variations of the fuel supply systems 18 within the combustor 12 and/or between combustors 12.

In the illustrated embodiment, the gas turbine system 10 includes four combustors 12 coupled to the turbine 28. However, in other embodiments, the gas turbine system 10 includes any number of combustors 12 (e.g., 2, 3, 4, 5, 6, 7, 8, 9, 10, 11, 12, 13, 14, 15, 16, or more combustors). In particular, each combustor 12 includes the fuel circuit 14 configured to provide the secondary fuel 16 to the pre-orifice 20 positioned in the fuel conduit 22 near the head 50 of the combustor 12. Further, the secondary fuel 16 is routed through the pre-orifice 20, through the fuel conduit 22, and through the post-orifice 24. In particular, the post-orifice 24 is configured to route the secondary fuel 16 from the secondary fuel nozzle 64, into the secondary combustion zone 62. As noted above, combustors 12 ignite and combust the air-fuel mixture (e.g., the secondary fuel 16 and/or compressed air 44), and then the hot combustion gases 34 are passed into the turbine 28. As the combustion gases 34 pass through the turbine blades in the turbine 28, various combustion dynamics may produce unwanted vibratory responses.

In some embodiments, the components of the fuel supply system 18 within the combustor 12 have variability among other components of the fuel supply system 18 within the same combustor 12. For example, in a first combustor 75, the first distance 72 (and thereby the acoustic volume) between the pre-orifice 20 and the post-orifice 24 of the first fuel supply system 17 is greater than a second distance 74 (and thereby the acoustic volume) between the pre-orifice 20 and the post-orifice 24 of the second fuel supply system 19. Particularly, in the illustrated example, the pre-orifice 20 is shifted along the fuel conduit 22 so that it is closer or further away from the post-orifice 24. As noted above, varying the distance between the pre-orifice 20 and the post-orifice 24 varies the acoustic volume between the pre-orifice 20 and the post orifice 24, and may be done by increasing or decreasing the length (and/or diameter) of one or more sections of tubing (e.g. flanged tubing), making up the fuel conduit 22. The pre-orifice 20 can be contained between the flanges (e.g. sandwich plate), or embedded as part of one of the sections of tubing. By varying the length of the sections of fuel conduit 22 positioned upstream and downstream of the pre-orifice 20, the distance (and/or diameter) between the pre-orifice and the post-orifice can be varied between fuel supply systems 18. Further, varying the acoustic volume among different fuel supply systems 18 (e.g., first fuel supply system 17 and the second fuel supply system 19) within the same combustor (e.g., the first combustor 75) may help to vary the fuel system impedance between the combustors 12. It should be noted that in other embodiments, as shown in FIG. 7, the combustor 12 may have variability among other fuel supply system 18 components, such as the size and/or shape and/or effective areas of the pre-orifice 20 or the post-orifice 24, the length of the fuel conduit 22, the diameter of the fuel conduit 22, the volume of the fuel conduit 22, the construction material of the components of the fuel supply systems 18, and so forth.

In some embodiments, the components of the fuel supply system 18 within the combustor 12 may have variability compared to the components of the fuel supply systems 18 among other combustors 12 within the system 10 (as shown in FIGS. 4, 7, and 8. For example, while the physical characteristics of the components (e.g., the pre-orifice 20, the fuel conduit 22, the post-orifice 24) of the fuel supply systems 18 of the second combustor 77 may be substantially similar, in some embodiments, the physical characteristics of the components of the fuel supply systems 18 of the second combustor 77 may be different from the physical characteristics of the fuel supply systems 18 of the first combustor 75 (e.g., the first fuel supply system 17 and/or the second fuel supply system 19), and the physical characteristics of the components of the fuel supply system 18 of the third combustor 79 may be different from the physical characteristics of the fuel supply systems 18 of the first combustor 75 and/or the second combustor 77 as in FIGS. 7 and 8). In the illustrated embodiment, the distance of the pre-orifice 20 relative to the post-orifice 24 of the second combustor 77 may be different between one or more fuel supply systems 18 of the second combustor 77. In other words, the position of the pre-orifice 20 along the fuel conduit 22 relative to the post-orifice 24 may be different between the fuel supply systems 18 of the second combustor 77. Indeed, it should be noted that the pre-orifice 20 may be disposed anywhere along the fuel conduit 22, such that the distance between the pre-orifice 20 and the post-orifice 24 along the fuel conduit 22 may be different between fuel supply systems 18 despite having a substantially similar length fuel conduit 22, as illustrated in the second combustor 77. Further, the position of the pre-orifice 20 along the fuel conduit 22 relative to the post-orifice 24 (e.g., the distance between the pre-orifice 20 and the post-orifice 24) within the second combustor 77 is different than the first distance 72 and/or the second distance 74 within the first combustor 75. Accordingly, the combustion dynamics and the acoustic fuel system impedance of the first combustor 75 relative to the second combustor 77 are different, thereby helping to reduce combustion dynamic amplitudes and/or possibly modal coupling of the combustion dynamics between the two combustors 12, and/or alter the phase delay between the two combustors 12.

In some embodiments, as shown in FIGS. 5 and 7, other physical characteristics may be varied between the components of the fuel supply systems 18 within the same combustor 12. For example, in the illustrated embodiment, the first diameter 78 of a third fuel supply system 21 of a third combustor 79 is larger than the second diameter 80 of a fourth fuel supply system 23 of the same third combustor 79. In some embodiments, the first distance 72 of the third fuel supply system 21 is greater than the second distance 74 of the fourth fuel supply system 23. Further, in some embodiments, the shape or physical configuration of the fuel supply systems 18 may vary within and/or between the combustors 12. For example, in a fourth combustor 81 shown in FIG. 4, the shape of the fuel conduit 22 within the fuel supply system 25 is curved convexly towards the exit 70 of the fourth combustor 81. In other physical configurations of the fuel supply system 18, the shape of the fuel conduit 22 may include one or more angles (e.g., jagged shape), waves, rough edges, and so forth, such that the one or more tubing sections of the fuel conduit 22 is shaped differently than adjacent fuel conduits 22 within or between the combustors 12. For example, a fuel supply system 27 of the fourth combustor 81 includes a fuel conduit 22 in a wave form. Further, in some embodiments, the fuel conduits 22 may include protrusions 82 (e.g., waves, rough edges, angles, and so forth) on an inner surface 84 of the fuel conduit 22 that provides variations in the fuel flow of the secondary fuel 16. The protrusions 82 may be formed from the same material as the fuel conduit 22. As noted above, such variations of the physical characteristics between various components of the fuel supply systems 18 help to reduce the amplitudes of the combustor tones and/or the coherence of the combustion dynamics.

FIG. 5 is a schematic of an embodiment of the third fuel supply system 21 and the fourth fuel supply system 23 of the third combustor 79, where the third combustor 79 is illustrated in FIG. 4. Specifically, the illustrated embodiment depicts physical variations between the third fuel supply system 21 and the fourth fuel supply system 23, such as variations in distance between the pre-orifice 20 and the post-orifice 24 and variations in diameter of the fuel conduit 22. For example, the first distance 72 between the pre-orifice 20 and the post-orifice 24 of the third fuel supply system 21 is greater than the second distance 74 between the pre-orifice 20 and the post-orifice 24 of the fourth fuel supply system 23. Further, the first diameter 78 of the fuel conduit 22 of the third fuel supply system 21 is greater than the second diameter 80 of the fuel conduit 22 of the fourth fuel supply system 23. Accordingly, a first acoustic volume 83 within the third fuel supply system 21 may be greater than a second acoustic volume 85 within the fourth fuel supply system 23. It should be noted that in other embodiments, the first acoustic volume 83 within a particular fuel supply system 18 may be different than the second acoustic volume 85 within another (e.g., adjacent) fuel supply system 18.

In some embodiments, other variations between the fuel supply systems 18 (e.g., the third fuel supply system 21 and the fourth fuel supply system 23) may exist. In certain embodiments, the width of the pre-orifice 20 may vary between different fuel supply systems 18. For example, a first width 86 (or diameter, cross-sectional area, shape, etc.) of the pre-orifice 20 in the third fuel supply system 21 may be greater than a second width 88 (or diameter, cross-sectional area, shape, etc.) of the pre-orifice 20 in the fourth fuel supply system 23. Similarly, a third width 90 (or diameter, cross-sectional area, shape, etc.) of the post-orifice 24 of the third fuel supply system 21 may be greater than a fourth width 92 (or diameter, cross-sectional area, shape, etc.) of the post-orifice 24 of the fourth fuel supply system 23. Further, the width of the pre-orifice 20 (e.g., the first width 86 and/or the second width 88) may be different than the width of the post-orifice 24 (e.g., the third width 90 and/or the fourth width 92) within and/or between the fuel supply systems 18 (e.g., between the fuel supply systems 21 and 23).

In yet other embodiments, the pre-orifices 20 and/or the post-orifices 24 may have physical characteristics (e.g., shape, dimensions, holes, thickness, material, arrangement, pattern, hole shape, hole size, etc.) that are different within and/or between combustors 12. For example, a first pre-orifice 94 of the third fuel supply system 21 may be different than a second pre-orifice 96 of the fourth fuel supply system 23, as explained further with respect to FIG. 6.

FIG. 6 is a schematic of an embodiment of the pre-orifices 20 of the fuel supply systems 18. Specifically, the pre-orifice 94 of the third fuel supply system 21 may have physical characteristics that vary from the second pre-orifice 96 of the fourth fuel supply system 23. For example, the pre-orifices 94 and 96 have differences in hole shapes and patterns, which may change the effective area and/or the pressure ratio of the mass flow of the secondary fuel 16 through the pre-orifices 94 and 96. In the illustrated embodiment, the pre-orifice 94 may include five circular holes arranged in an annular pattern around a central hole 100. Further, the pre-orifice 96 may include five triangular holes 102 arranged in an annular pattern around a central square 104. However, it should be noted that in other patterns and configurations, any number of holes (e.g., 1, 2, 3, 4, 5, 6, 7, 8, 9, 10, etc.) may be arranged in any shape or pattern (symmetrical, spirals, random, waves, checkered, etc.), such that the pre-orifices 94 and 96 are different from one another.

In some embodiments, as shown in FIG. 7, variations between the fuel supply systems 18 in different combustors (e.g., between the first fuel supply system 17 of the first combustor 75 and the third fuel supply system 21 of the second combustor 79) may exist, instead of, or in addition to, differences between the fuel supply systems 18 of each combustor. In the first fuel supply system 17 of the first combustor 75, the pre-orifice 20 has a first thickness 106 and multiple orifice holes, each having a width 116 (or diameter, cross-sectional area, shape, etc.); the fuel conduit 22 has a first diameter 126; the post-orifice 24 defines a first width 136; and a first acoustic volume 123 is defined over the distance 72 between the pre-orifice 20 and the post-orifice 24. In the second fuel supply system 19 of the first combustor 75, the pre-orifice 20 has a second thickness 108 and an orifice hole having a width 118 (or diameter, cross-sectional area, shape, etc.); the fuel conduit 22 has a second diameter 128; the post-orifice 24 defines a second width 138; and a second acoustic volume 133 is defined over the distance 74 between the pre-orifice 20 and the post-orifice 24. In the third fuel supply system 21 of the third combustor 79, the pre-orifice 20 has a third thickness 112 and an orifice hole having a width 86 (or diameter, cross-sectional area, shape, etc.); the fuel conduit 22 has a third diameter 78; the post-orifice 24 defines a third width 90; and a third acoustic volume 83 is defined over the distance 72 between the pre-orifice 20 and the post-orifice 24. In the fourth fuel supply system 23 of the third combustor 79, the pre-orifice 20 has a fourth thickness 114 and an orifice hole having a width 88 (or diameter, cross-sectional area, shape, etc.); the fuel conduit 22 has a fourth diameter 80; the post-orifice 24 defines a fourth width 92; and a fourth acoustic volume 85 is defined over the distance 74 between the pre-orifice 20 and the post-orifice 24.

As illustrated, the first fuel supply system 17 of the first combustor 75 has components that are different from the third fuel supply system 21 of the third combustor 79 (e.g., in number of orifices, width/size of pre-orifice, thickness of pre-orifice, diameter of fuel conduit, and/or width of post-orifice), even though the distance 72 between the pre-orifice 20 and the post-orifice 24 is the same. Additionally, or alternately, the second fuel supply system 19 of the first combustor 75 has components that are different from the fourth fuel supply system 23 of the third combustor 79 (e.g., in number of orifices, width/size of pre-orifice, thickness of pre-orifice, diameter of fuel conduit, and/or width of post-orifice), even though the distance 74 between the pre-orifice 20 and the post-orifice 24 is the same. The differences in the number of orifices and the width/size of the pre-orifices is shown schematically in FIG. 8.

Technical effects of the invention include reducing unwanted vibratory responses associated with combustion dynamics within or among combustors 12 of the gas turbine system 10 by varying the physical characteristics of the pre-orifice 20 within the one or more fuel supply systems 18 of the combustor 12 to adjust the fuel system acoustic impedance (magnitude and phase) within the system 10. For example, from one fuel conduit 22 to another, the position of the pre-orifice 20 may be shifted along the fuel conduit 22, so that it is closer or further away from the post-orifice 24, thereby changing the acoustic volume between the pre-orifice 20 and the post-orifice 24. In other embodiments, the physical characteristics of other components of the fuel supply systems 18 (e.g., the post-orifice 24, the fuel conduit 22, and the pre-orifice 20) may be varied within or among the combustors 12. For example, the dimensions (e.g., length, width, diameter, volume) of the fuel conduit 22, the size and/or shape (e.g., width, length, diameter, effective area) of the pre-orifice 20 and/or the post-orifice 24, the patterns or configurations of the pre-orifice 20 or the post-orifice 24 (e.g., holes, arrangements of the holes, etc.), the shape of the fuel conduit 22, the inner surface of the fuel conduit 22, and so forth, may vary between one or more fuel supply systems 18 within the same combustor 12 or among different combustors 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a gas turbine engine, comprising;

a first combustor comprising a first liner circumscribing a first primary combustion zone and a first secondary combustion zone downstream of the first primary combustion zone and a first fuel injector disposed along the first liner and configured to inject a fuel, via a first fuel outlet, through the first liner into the first secondary combustion zone of the first combustor, the first fuel injector being located at a first distance from a first outlet of the first combustor;

a second combustor comprising a second liner circumscribing a second primary combustion zone and a second secondary combustion zone downstream of the second primary combustion zone and a second fuel injector disposed along the second liner and configured to inject the fuel, via a second fuel outlet, through the second liner into the second secondary combustion zone of the second combustor, the second fuel injector being located at a second distance from a second outlet of the second combustor;

a first fuel conduit extending axially along a first outer surface of the first liner and supplying the fuel to the first fuel injector;

a first pre-orifice installed inside the first fuel conduit, such that a first volume of the first fuel conduit is defined between the first pre-orifice and the first fuel outlet;

a second fuel conduit extending axially along a second outer surface of the second liner and supplying the fuel to the second fuel injector; and a second pre-orifice installed inside the second fuel conduit, such that to a second volume of the second fuel conduit is defined between the second pre-orifice and the second fuel outlet, wherein the first volume and the second volume are different from one another; and wherein the first distance is equal to the second distance;

wherein the first pre-orifice comprises a first geometry, and the second pre-orifice comprises a second geometry, wherein one or more first geometric differences between the first geometry of the first pre-orifice and the second geometry of the second pre-orifice reduce coherence between the first combustor and the second combustor or alter a phase between the first combustor and the second combustor; and wherein the one or more first geometric differences between the first geometry of the first pre-orifice and the second geometry of the second pre-orifice comprises one or more of a number of orifices and an arrangement of a plurality of orifices.

2. The system of claim 1, wherein the first combustor comprises a first fuel nozzle upstream from the first fuel injector, the first fuel nozzle being configured to inject the fuel into the first primary combustion zone of the first combustor; and wherein the second combustor comprises a second fuel nozzle upstream from the second fuel injector, the second fuel nozzle being configured to inject the fuel into the second primary combustion zone of the second combustor.

3. The system of claim 1, wherein the one or more first geometric differences between the first geometry of the first pre-orifice and the second geometry of the second pre-orifice additionally comprises one or more of an orifice shape, an orifice dimension, an axial position, and a cross-sectional area.

4. The system of claim 1, wherein the first fuel conduit comprises a first conduit geometry and the second fuel conduit comprises a second conduit geometry, and wherein one or more second geometric differences between the first conduit geometry and the second conduit geometry alter a phase and/or reduce coherence between the first combustor and the second combustor.

5. The system of claim 4, wherein the one or more second geometric differences between the first conduit geometry and the second conduit geometry comprises one or more of a length, a width, a diameter, an inner surface, and a shape.

6. A system, comprising:

a first combustor of a gas turbine system, comprising:

a first liner circumscribing a first primary combustion zone and a first secondary combustion zone downstream of the first primary combustion zone;

a first fuel injector disposed along the first liner and comprising a first fuel outlet configured to inject a fuel through the first liner into the first secondary combustion zone, the first fuel injector being located at a first distance from a first outlet of the first combustor;

a second fuel injector disposed along the first liner and comprising a second fuel outlet configured to inject the fuel through the first liner into the first secondary combustion zone, the second fuel injector being located at a second distance from the first outlet of the first combustor;

a first fuel conduit extending axially along an outer surface of the first liner and supplying the fuel to the first fuel injector;

a first pre-orifice installed inside the first fuel conduit, wherein the first fuel conduit has a first conduit geometry between the first pre-orifice and the first fuel outlet, and wherein the first pre-orifice has a first pre-orifice geometry;

a second fuel conduit extending axially along the first outer surface of the first liner and supplying the fuel to the second fuel injector; and a second pre-orifice installed inside the second fuel conduit, wherein the second fuel conduit has a second conduit geometry between the second pre-orifice and the second fuel outlet, and wherein the second pre-orifice has a second pre-orifice geometry;

wherein the first conduit geometry and the second conduit geometry are different from one another, or the first pre-orifice geometry and the second pre-orifice geometry are different from one another, or a combination thereof; and wherein the first distance is equal to the second distance; and wherein one or more first geometric differences between the first pre-orifice geometry of the first pre-orifice and the second pre-orifice geometry of the second pre-orifice comprise differences in a number of orifices or an arrangement of a plurality of orifices.

7. The system of claim 6, wherein the one or more first geometric differences between the first pre-orifice geometry of the first pre-orifice and the second pre-orifice geometry of the second pre-orifice additionally comprise differences in an orifice shape, an orifice dimension, an axial position, or a cross-sectional area.

8. The system of claim 6, wherein the first fuel outlet comprises a third orifice geometry and the second fuel outlet comprises a fourth orifice geometry, wherein the third orifice geometry is different from the fourth orifice geometry.

9. The system of claim 6, wherein the first conduit geometry between the first pre-orifice and the first fuel outlet corresponds to a first volume between the first pre-orifice and the first fuel outlet; wherein the second conduit geometry between the second pre-orifice and the second fuel outlet corresponds to a second volume between the second pre-orifice and the second fuel outlet; and wherein the second volume is different from the first volume.

10. The system of claim 9, wherein one or more differences between the first volume and the second volume reduce combustion dynamics amplitudes between the first fuel injector and the second fuel injector of the first combustor.

11. The system of claim 6, wherein the system comprises a second combustor comprising a second liner circumscribing a second primary combustion zone and a second secondary combustion zone; and wherein the second combustor is equipped with a third fuel injector in fluid communication with a third fuel conduit, the third fuel injector being disposed along the second liner and configured to inject the fuel through the second liner into the second secondary combustion zone, the third fuel injector being located at a third distance from a second outlet of the second combustor; and wherein the third fuel conduit extends axially along a second outer surface of the second liner and has one or more second geometric differences relative to the first fuel conduit or the second fuel conduit of the first combustor, and the third distance is equal to the first distance.

12. A gas turbine engine comprising:

a first combustor comprising;

a first liner circumscribing a first primary combustion zone and a first secondary combustion zone downstream of the first primary combustion zone;

a first fuel injector disposed along the first liner and configured to inject a fuel, via a first fuel outlet, through the first liner into the first secondary combustion zone of the first combustor, the first fuel injector being located at a first distance from a first outlet of the first combustor;

a first fuel conduit extending axially along a first outer surface of the first liner and supplying the fuel to the first fuel injector, the first fuel conduit having a first cross-sectional diameter; and a first pre-orifice installed inside the first fuel conduit, such that a first volume of the first fuel conduit is defined between the first pre-orifice and the first fuel outlet;

a second combustor comprising:

a second liner circumscribing a second primary combustion zone and a second secondary combustion zone downstream of the second primary combustion zone;

a second fuel injector disposed along the second liner and configured to inject the fuel, via a second fuel outlet, through the second liner into the second secondary combustion zone of the second combustor, the second fuel injector being located at a second distance from a second outlet of the second combustor, wherein the second distance is equal to the first distance;

a second fuel conduit extending axially along a second outer surface of the second liner and supplying the fuel to the second fuel injector, the second fuel conduit having a second cross-sectional diameter different from the first cross-sectional diameter;

a second pre-orifice installed inside the second fuel conduit, such that a second volume of the second fuel conduit is defined between the second pre-orifice and the second fuel outlet;

wherein the first volume is different from the second volume; and wherein the first pre-orifice has at least one first geometric difference from the second pre-orifice, the at least one first geometric difference being a difference in a number of orifices and a difference in a arrangement of a plurality of orifices.

13. The gas turbine engine of claim 12, wherein the first fuel conduit and the second fuel conduit have at least one second geometric difference in addition to a difference between the first cross-sectional diameter and the second cross-sectional diameter, the at least one second geometric difference comprising a difference in length, a difference in an inner surface, and a difference in conduit shape.

14. The gas turbine engine of claim 12, wherein the at least one first geometric difference additionally comprises a difference in an orifice shape, a difference in an orifice dimension, a difference in a cross-sectional area, and a difference in an axial position of a respective pre-orifice within a respective fuel conduit.

* * * * *